US005734247A

United States Patent [19]

Wussmann et al.

[11] Patent Number: 5,734,247

[45] Date of Patent: *Mar. 31, 1998

[54] METHOD OF AND APPARATUS FOR CONTROLLING THE MOVEMENT OF MACHINE ELEMENT

[75] Inventors: Holger Wussmann, Eislingen; Hartmut Kaak, Ebersbach/Fils; Dietmar Stähle, Adelberg, all of Germany

[73] Assignee: Zinser Textilmaschinen GmbH, Ebersbach/Fils, Germany

[ * ] Notice: The term of this patent shall not extend beyond the expiration date of Pat. No. 5,537,018.

[21] Appl. No.: 640,094

[22] Filed: Apr. 30, 1996

Related U.S. Application Data

[63] Continuation of Ser. No. 358,076, Dec. 15, 1994, Pat. No. 5,537,018.

[30] Foreign Application Priority Data

Dec. 16, 1993 [DE] Germany ..... 43 43 020.1

[51] Int. Cl.[6] ..... G05B 1/06

[52] U.S. Cl. ..... 318/652; 318/638

[58] Field of Search ..... 318/652, 638, 318/603, 605, 602, 611, 635, 636, 637, 612, 568.13, 601, 367, 632, 366

[56] References Cited

U.S. PATENT DOCUMENTS

| | | | |
|---|---|---|---|
| 4,398,138 | 8/1983 | Kohzai et al. | 318/603 |
| 4,800,325 | 1/1989 | Nakanishi | 318/605 |
| 4,968,923 | 11/1990 | Busujima | 318/632 |
| 5,048,063 | 9/1991 | Isobe et al. | 318/638 |
| 5,210,562 | 5/1993 | Miyazawa et al. | 318/636 |

*Primary Examiner*—John W. Cabeca
*Attorney, Agent, or Firm*—Herbert Dubno

[57] ABSTRACT

A method of and an apparatus for controlling the drive of a machine element of a spinning or twisting machine for exact positioning of the machine element at setpoint positions within a certain tolerance limit using motors which are not speed variable and are controlled by an on-off switch. The overshooting of the setpoint position can be detected and the measure of overshoot used as correction values for subsequent approaches to the setpoint position or to allow reverse approach to the setpoint with detection of overshoot beyond the tolerance and then a new approach with the iteration to a deviation less than the tolerance limit or a maximum number of cycles.

5 Claims, 1 Drawing Sheet

METHOD OF AND APPARATUS FOR CONTROLLING THE MOVEMENT OF MACHINE ELEMENT

CROSS REFERENCE TO RELATED APPLICATION

This application is a continuation of Ser. No. 358,076, filed Dec. 15, 1994, now U.S. Pat. No. 5,537,018 and is related to U.S. Pat. No. 5,555,713 and based upon German application P 43 43 019.8 of 16 Dec. 1993, incorporated herein in its entirety by reference.

FIELD OF THE INVENTION

Our present invention relates to a method of or a process for controlling a drive of a machine element, especially a machine element for a spinning machine. The invention also relates to an apparatus for controlling such a drive or an apparatus incorporating a drive as thus controlled.

BACKGROUND OF THE INVENTION

For the operation of movable machine parts, one of the most important considerations is the simplification and reduction of cost of the drive and, particularly for machine elements of spinning and twisting machinery, it is advantageous to utilize drives which are not controllable with respect to speed because the increase in complexity is concomitant with a decrease in reliability in many instances.

It is, therefore, an advantage in spinning and twisting machines for the control of movable machine elements to utilize electric motors as the prime mover of such drives and to effect control in the simplest and most economical manner. Drives are used for a variety of machine elements in spinning and twisting machines. For example, in the apparatus described in German Patent Document DE 40 05 418 C1 the moving machine element is provided for doffing the bobbins from and applying the bobbin-winding cores and sleeves onto the spindles or work stations of the spinning or twisting machine. The apparatus utilizes a movable machine element which must be displaced into predetermined positions and an absolute value sensor is provided to detect the position of the machine element and to signal the actual position to the control unit. The control unit then compares the actual position to the setpoint of the position approached by the machine element and controls the drive to bring the machine element to that desired position.

When, however, nonregulatable drives, i.e. drives whose speeds are not controllable, are used, it is not unknown that the setpoint position to be approached by the machine element will be overrun when the drive is deactivated upon coincidence of the actual position with the respective setpoint position. This is especially the case when the movable machine element has considerable mass with a correspondingly large inertia since there is a finite time after deactivation of the drive before the machine element is brought to standstill and, within this period, the inertia can cause significant travel of the machine element.

A solution to this problem is to inactivate the drive when the actual position of the machine element coincides with a point corresponding to the setpoint position reduced by a predetermined magnitude.

Even with such a control process, intolerable inaccuracies can occur with approach of the machine element to the setpoint position as a consequence, for example, of changes in the moving mass, of contamination of the bearings, of temperature-dependent variations in the viscosity of lubricants, etc.

The use of such drives is especially problematical in cases in which the movement of the machine parts must be effected with different but constant speeds since, upon a rapid movement of a machine element, the energy stored in the moving parts is significantly greater than is the case with more slowly moving machine elements so that the overrun differs also with respective speeds.

The problem arises not only with setpoints which are generated by calculation or measurement, but also where so-called "teach-in" processes are used to program the setpoint position. Such a process for programming the setpoints of ann apparatus for doffing bobbins and applying the bobbin-winding cores or sleeves on a spinning machine or twisting machine is known, for example, from DE 40 05 418 C1. In this process, the setpoints are recorded in memory by a run through of the movement of the machine element under manual control and by recording the positions of the setpoints manually as well. The speed is substantially reduced during the teach-in run through. However, because of the inertia in the moving elements of the drive, inaccuracies upon approach to the setpoint position can arise when the machine elements are moved at higher operating speeds.

The other effects like contamination of bearings, mass changes and the like also generally cannot be taken into account during the teaching process.

Mention should also be made of German Patent Document DE 40 21 800 A1 which describes a process for controlling a positioning unit of an automated or other apparatus in which the approach to the setpoint position is effected through the use of a setpoint curve depending upon the distance between the art and target positions. This, of course, requires a speed-regulatable drive of greater complexity and cost than the drives with which the invention is concerned. German Patent Document DE 39 19 687 C2 describes a spinning machine with individual spindle drives whereby each individual drive is coupled with the auxiliary units of the spinning machine via a processor-controlled unit. This ensures an exact matching of the speed of the drive for the auxiliary unit especially the drafting velocity to the speed of the individual spindle drive. The result is an improvement in the yarn quality or the generation of yarns with different features.

OBJECTS OF THE INVENTION

The principal object of the present invention is to provide a method of or process for controlling a drive for a machine element, especially of a spinning machine which allows greater precision of positioning the machine element at the respective setpoint positions.

Another object of the invention is to provide an improved drive for a machine element which can operate without the reliability problems of speed control units and which is therefore free from drawbacks of earlier systems.

Still another object of the invention is to provide an improved drive control method and apparatus which can be utilized effectively for apparatus of the type described in our aforementioned copending application, i.e. the positioning of the conveyor belt carrying the bobbins and empty bobbin-winding cores or sleeves, and for other machine elements of a spinning machine, e.g. a doffer, spindle rail, ring rail, or the like, utilizing economical electric motors.

Still another object of the present invention is to provide an improved method of and apparatus for driving machine elements of a spinning or twisting machine whereby drawbacks of prior art systems can be avoided.

SUMMARY OF THE INVENTION

These objects and others which will become apparent hereinafter are attained, in accordance with the invention in a method of controlling a drive for a machine element which comprises:

(a) operating the drive to displace the machine element from a first position to at least one other position determined by a setpoint and which can be one of a plurality of positions determined by respective setpoints and adapted to be assumed by the machine element in successive operations;

(b) detecting an instantaneous actual position of the machine element and generating actual position signals representing the instantaneous actual position of the machine element from an absolute value or relative value signal generator operatively coupled to the machine element;

(c) automatically comparing the instantaneous actual position as represented by the signals with a respective setpoint and deactivating the drive in dependence upon the comparison of the instantaneous actual position and a setpoint position corresponding to the respective setpoint to bring the machine element to standstill;

(d) upon deactivation of the drive and standstill of with the respective setpoint position (S) to determine a deviation therefrom;

(e) upon the deviation exceeding a predetermined value (δ) activating the drive to displace the machine element in a direction of the setpoint position and again deactivating the drive upon coincidence of the instantaneous actual position and a setpoint position corresponding to the respective setpoint to bring the machine element to standstill; and (f) repeating steps (d) and (e) until the determined deviation is less than the predetermined value (δ) or a predetermined number of repetitions of cycles of steps (c) and (d) is reached.

In this embodiment, after deactivation of the drive and standstill of the machine element, the invention detects whether the deviation between the actual position and the setpoint position is smaller than a predetermined value. If the detected variation is greater than this value, the drive is again activated in the direction of the same setpoint position and again deactivated in dependence upon the comparison of the actual position with the setpoint position. Then after standstill of the machine element the deviation between the actual and setpoint positions is determined and the deviation is tested as to whether it lies within the predetermined tolerance. These process steps are repeated as long as and until a predetermined precision of approach to the setpoint position or a predetermined number of cycles of these steps is reached.

This has the advantage that imprecision upon approach to the setpoint position is significantly reduced without the need for an expensive speed-variable drive.

Alternatively the invention comprises a method of controlling such a drive which comprises:

(a) operating the drive to displace the machine element from a first position to at least one other position determined by a setpoint and which can be one of a plurality of positions determined by respective setpoints and adapted to be assumed by the machine element in successive operations;

(b) detecting an instantaneous actual position of the machine element and generating actual position signals representing the instantaneous actual position of the machine element from an absolute value or relative value signal generator operatively coupled to the machine element;

(c) automatically comparing the instantaneous actual position as represented by the signals with a respective setpoint and deactivating the drive in dependence upon the comparison of the instantaneous actual position and a setpoint position corresponding to the respective setpoint to bring the machine element to standstill;

(d) upon deactivation of the drive and standstill of the machine element comparing an actual position ($Q_A$, $Q_B$, $Q_C$) with the respective setpoint position (S) to determine a deviation therefrom; and (e) upon a subsequent approach to the same setpoint position, deactivating the drive upon comparison of an actual position ($Q_A$, $Q_B$, $Q_C$) with the respective setpoint position (S) modified by the deviation or by a plurality of deviations previously ascertained by comparisons of actual positions with the setpoint position.

In this second approach to the process the deviation of the actual position from the setpoint position is also determined after standstill of the machine element. The difference from the previous process is that the deviation as thus determined is only utilized in a new approach to the same setpoint position in a subsequent operation. The drive is then cut off in the subsequent operation by agreement between the setpoint position and the particular setpoint position, corrected based upon one or more prior approaches to that setpoint position.

By comparison with the first process, this system avoids a back and forth operation eliminating the imprecision of approach to the setpoint position. The drawback, however, is that each subsequent approach is effected with greater precision.

Of course the advantages of both approaches can be obtained by a method, according to the invention, which comprises:

(a) operating the drive to displace the machine element from a first position to at least one other position determined by a setpoint and which can be one of a plurality of positions determined by respective setpoints and adapted to be assumed by the machine element in successive operations;

(b) detecting an instantaneous actual position of the machine element and generating actual position signals representing the instantaneous actual position of the machine element from an absolute value-or relative value signal generator operatively coupled to the machine element;

(c) automatically comparing the instantaneous actual position as represented by the signals with a respective setpoint and deactivating the drive in dependence upon the comparison of the instantaneous actual position and a setpoint position corresponding to the respective setpoint to bring the machine element to standstill;

(d) upon deactivation of the drive and standstill of the machine element comparing an actual position ($P_I$, $P_{II}$, $P_{III}$) with the respective setpoint position (S) to determine a deviation therefrom;

(e) upon the deviation exceeding a predetermined value (δ) activating the drive to displace the machine element in a direction of the setpoint position and again deactivating the drive upon coincidence of the instantaneous actual position and a setpoint position corresponding to the respective setpoint to bring the machine element to standstill; and (f) repeating steps (d) and (e) until the determined deviation is less than the predetermined value (δ) or a predetermined number of repetitions of cycles of steps (c) and (d) is reached; and (g) upon a subsequent approach to the same setpoint position, deactivating the drive upon comparison of an actual position ($Q_A$, $Q_B$, $Q_C$) with the respective setpoint position (S) modified by the deviation or by a plurality of deviations previously ascertained by comparisons of actual positions with the setpoint position.

With this system even with the first approach to each setpoint position, high accuracy is obtained while the accuracy is increased for all subsequent approaches to the same setpoint positions and, of course, at each setpoint position the number of correction cycles can be greatly reduced in such subsequent approaches.

The apparatus of the invention can comprise:

a machine element of a spinning machine displaceable from a first position to at least one other position determined by a setpoint and which can be one of a plurality of positions determined by respective setpoints and adapted to be assumed by the machine element in successive operations;

a signal generator connected to the machine element generating actual position signals representing the instantaneous actual position of the machine element as an absolute value or relative value;

means for automatically comparing the instantaneous actual position as represented by the signals with a respective setpoint and deactivating the drive in dependence upon the comparison of the instantaneous actual position and a setpoint position corresponding to the respective setpoint to bring the machine element to standstill;

control means effective upon deactivation of the drive and standstill of the machine element for comparing an actual position ($P_I$, $P_{II}$, $P_{III}$) with the respective setpoint position (S) to determine a deviation therefrom, the control means being programmed upon the deviation exceeding a predetermined value (δ) activating the drive to displace the machine element in a direction of the setpoint position and again deactivating the drive upon coincidence of the instantaneous actual position and a setpoint position corresponding to the respective setpoint to bring the machine element to standstill, and to repeat comparing an actual position ($P_I$, $P_{II}$, $P_{III}$) with the respective setpoint position (S) to determine a deviation therefrom until the determined deviation is less than the predetermined value (δ) or a predetermined number of repetitions of cycles of comparing an actual position ($P_I$, $P_{II}$, $P_{III}$) with the respective setpoint position (S).

The drive can be therefore a simple, nonregulatable electric motor with an on-off electronic switch controllable by the controlled program unit of the apparatus to connect the motor to or disconnect the motor from an energy source. The motor can, in particular, be a simple asynchronous motor.

In all of the methods set forth, the drive is preferably inactivated in step (c) when the instantaneous actual position coincides with the setpoint position.

Each first approach to a setpoint position can determine a deviation (δ) in step (d) which is added with a correct sign to a correction value, whereupon deactivation of the drive can be effected when the actual position corresponds to the et point corrected with that correction value.

In all cases, moreover, the setpoints can be established by a teach-in process by manually displacing the machine element at a speed less than a speed subsequently used for machine operation and manually registering the respective setpoints.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
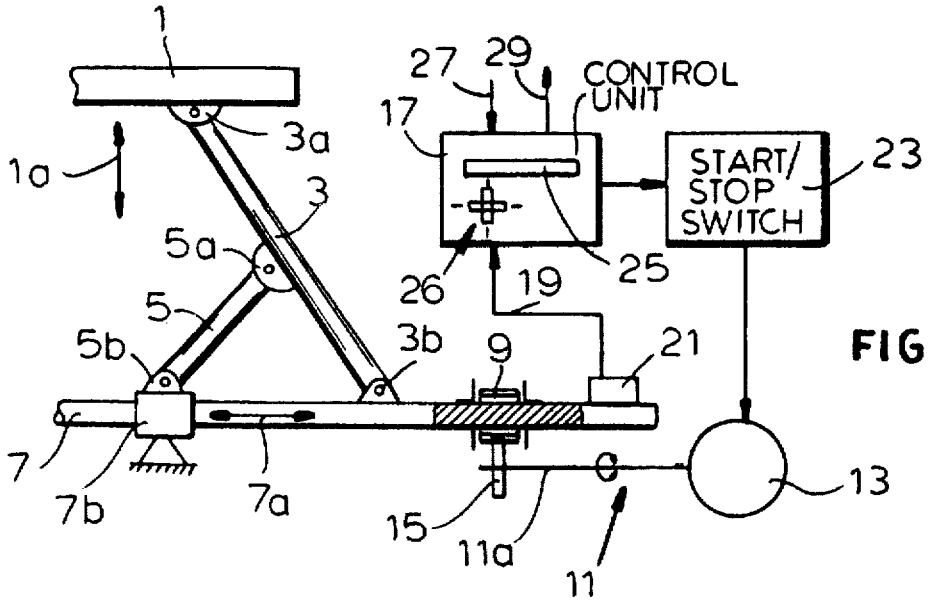
FIG. 1 is a schematic side elevational view of an apparatus for controlling a moving machine part, such as a doffing unit of a spinning or twisting machine provided with the drive of the present invention.

FIG. 1 shows the application of the principles of the present invention to a doffing system, i.e. a system for removing bobbins from and mounting bobbin winding cores or sleeves, upon a spinning or twisting machine as is described in German Patent Document DE 40 05 418 C1.

It can also be used for positioning of the belt in the above-identified copending application, or for wherever positioning of a machine element in a spinning or twisting machine is required with accuracy, e.g. in the positioning of a ring rail or spindle rail.

The apparatus comprises, on each of the longitudinal sides of the machine, i.e. the spinning or twisting machine provided with multiplicity of spindles or work stations on each side, a respective gripper beam 1 which can be raised and lowered on a scissor linkage which comprises a plurality of supporting arms 3 and pivotal struts 5. The support arms 3 are pivotally connected at **3*a* with the gripper beam 1 and extend from the gripper beam to a threaded spindle 7 which is nonrotatable but is axially shiftable in the direction of arrow 7*a* within a sleeve 7*b* by a nut 9 which is axially fixed but can be rotated relative to the spindle 7. The support arm 3 is pivotally connected at 3*b* to the spindle 7. The pivotal struts or arms 5 are pivotally connected at 5*a* with the respective support arms 3 midway of the length thereof and are pivotally connected at 5*b* to the stationary sleeves 7*b***.

By an appropriate drive represented at 11, a rotation of the nut 9 can axially shift the spindle 7 to raise and lower the machine element or gripper beam 1 as represented by the double headed arrow l*a*. The transmission 11 can be effected by a pinion 15 meshing with the peripheral gearing of the nut 9 and driven by a shaft **11*a* from the electric motor 13. Since the nut 9 is axially fixed, rotation of this nut in one or the other sense will axially displace the shaft 7 in one or the other of the directions represented by the arrow 7*a***.

The gripper beam is provided with means for engagement with the empty bobbin cores or sleeves and for engagement with the full bobbins but not shown herein. What is important is that the gripper beam 1 and its grippers be set into a plurality of predetermined setpoint positions.

For control of the gripper beam at the setpoint positions, a control unit 17 is provided. To this control unit 17 is fed the starting signal 19 from a position sensor juxtaposed with the spindle 7 and generating a pulsed output representing the actual value of the position of the gripper beam 1 represented by the actual value of the position of the spindle 7. The control unit 17 operates the motor controller 23 which can be an electronic switch connecting the motor 13 to the power line. The position sensor 21 can be an absolute value generator or a relative value generator. It can be realized as an incremental axial sensor providing pulses with each increment of movement of the spindle 7. Of course, a rotary pulse generator (see the aforementioned application) can be provided as well, coupled to the nut 9. The absolute position of the beam 1 can be obtained from counting the pulses from the signal generator 19 after switching on the machine from a starting position of the spindle 7 as determined by a limit switch, for example. The setpoint positions can be determined either by calculation and manually set in memory off the microprocessor unit 17 or by a so-called teach-in process. The means for programming the unit 17 have not been illustrated and generally will include cursor buttons 26 and a display 25. By manually advancing the beam 1 to the various setpoint positions as read on the display 25, the buttons 26 can be operated to record the setpoints in the memory of the unit 17 or the unit 117 can be connected by an appropriate interface to a programming computer, the keys of which can record the setpoints in memory.

For the manual approach to the setpoint positions in teach-in operation, the control unit 17 can so control the energy supply from switch 23 to the motor 13 that the motor 13 is stepped slowly to the set point position, thereby ensuring an approach with high accuracy to the desired positions.

In normal operations, the energy supply unit 23 can be so constructed, if desired, that it operates the motor in teach-in operation at a constant low speed but for normal operations operates the motor 13 with a constant higher speed. The electronic switch 23 can thus also switch the motor between two fixed voltages or two fixed constant current sources as desired.

After ending the teach-in process, the control unit 17 is switched into "normal" operation in which the control unit regulates approach to each in the setpoint position in accordance with its program. The commencement of operations can be effected from a central machine control via start signal 27, for example.

In the "normal" mode the unit 17 turns on and off the electronic switch 23 which operates the motor with a substantially higher speed than that which prevail during the teach-in process. As a result of the inertia of the mass which is moved, various inaccuracies of the positioning of the machine element can occur upon approach to the set point positions of the gripper beam 1 or the spindle 7.

For example, when the apparatus is in its "normal" mode and the sensor signal 19 detects an actual position which apparently coincides with the setpoint position previously stored during the teach-in stage, standstill of the element 1 or 7 does not occur until some instance thereafter as a result of inertial. Furthermore, the particular instant at which standstill is achieved cannot be predicted with accuracy because of changes in the mass and hence of the inertia of the machine elements, i.e. the gripper beam 1 and the parts attached thereto. This can occur when, for example, instead of heavy cops or bobbins, only light empty sleeves or cores must be moved from one position to another position. Varying conditions which can effect the degree of overrun can include temperature differences, contamination of the moving parts, wear of the various parts, so that intolerable inaccuracies can arise in the positions at which the machine element will accurately halt.

According to the invention, after a first approach to a setpoint position, i.e. after the electric motor 13 has been deactivated and the moving machine element, the gripper beam 1 or the spindle 7, has been brought to standstill, the deviation of the instantaneous actual position from the setpoint position is determined and compared with a stored permissible value or tolerance. This value is stored in the control unit. If this value is exceeded, the control unit 17 operates the drive 11 in the direction of the desired setpoint position anew. After this new approach (and standstill) the actual position is again compared with the setpoint position and the deviation tested against the allowable tolerance These steps are repeated until the setpoint position is achieved with sufficient accuracy. To prevent an endless loop from developing, the positioning process interrupted when a predetermined number of approach cycles has been achieved.

Figure 2:
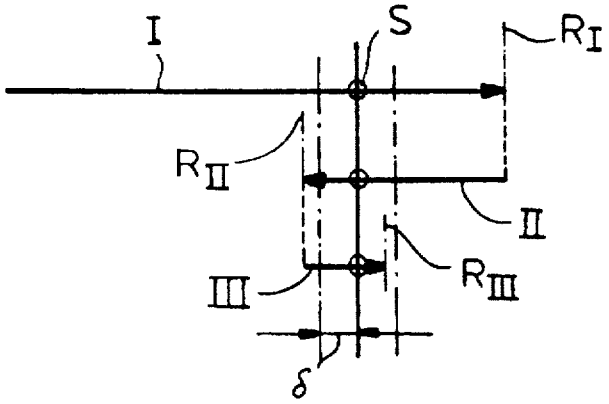
FIG. 2 is a schematic illustration of the movements of a machine element in accordance with a first embodiment of the invention process for controlling the drive.

FIG. 2 shows schematically one sequence of approaches to a setpoint position S with an ultimate precision or tolerance of a predetermined amount ($\delta$). As can be seen from FIG. 2, the deactivation of the drive, i.e. the electric motor 13 in the first approach cycle I is effected when the actual value detected by the sensor 21 coincides with the setpoint S. Because of the inertia of the mass of the moving parts, the spindle 7 travels beyond or overshoots the setpoint S to end its movement at a first position $P_1$. This position, as can be seen from FIG. 2, is outside the tolerance range $S \pm(\delta)$ so that the control unit 17 operates the drive 11 in the reverse direction, i.e. toward the setpoint position S in a second approach cycle II.

The drive 1 is deactivated when the actual position again coincides with the setpoint position S but, since the drive as operated only briefly from the position $P_I$ to the position S, the full momentum of the drive is not built up so that the overshoot to position $P_{II}$ is less but such that the shorter stretch $S\text{-}P_{II}$ to standstill of the machine element is still greater than $\delta$. The control unit 17 compares the overshoot with $\delta$ in accordance with the relationship $S\text{-}P_{II}>\delta$ and triggers the drive 11 into operation for a third approach cycle III.

After the end of this third approach cycle, which is effected in the manner described, the spindle reaches a position $P_{III}$ as predetermined by the sensor signals 19 supplied to the control unit 17. The setpoint position S is reached within the sufficient tolerance or precision $\pm\delta$. The cycling thus terminates and the end of the cycling can be signalled at 29 enabling further operations in the bobbin change process to be commenced.

Instead of deactivating the drive in the approach cycles I–III upon coincidence of the actual position with the setpoint position, deactivation can be effected at an earlier point in time or upon attaining of an actual position which is smaller by a predetermined amount than the intended setpoint position. This amount can be independent of the overshoot.

Figure 3:
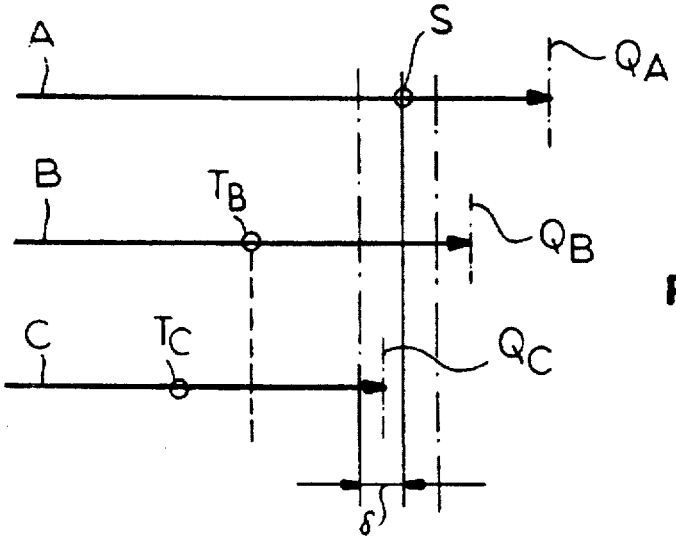
FIG. 3 is a diagram similar to FIG. 2 illustrating a second embodiment of the invention.

FIG. 3 shows a further embodiment of the process of the invention. Here the drive 11 is deactivated following a first approach A when the setpoint position and the actual position coincide as is the case with FIG. 2, the result is an overshoot of the setpoint position S by an amount $Q_A$-S.

Instead of reversing the drive and a new approach to the setpoint position S at this time, the drive remains in the position $Q_A$ and the operation is conducted although without the accurate positioning of the machine element. In the control unit 17, however, the magnitude of the overshoot $Q_A$-S is stored and is subtracted from the position S so that at the next approach B to this setpoint position the drive is deactivated as a consequence of this stored valued. Preferably the drive is inactivated in the second approach process when the control unit 17 determines from the sensor signals 19 that the machine element is in a position $T_B=S-(Q_A-S)$. At the end of the second approach process B, the machine element is in the end position $Q_B$ which also lies outside the permissible tolerance range $S \pm\delta$ so that the correction value $Q_B$-S is added to the first correction value $Q_A$-S and the third approach process to the same setpoint is effected with deactivation of the drive 11 in the position $T_C$=S−($Q_A$-S)−($Q_B$-S).

The spindle 7 then reaches standstill in the position over C which lies within the tolerance range S ±δ and the control unit 17 thus detects standstill with sufficient accuracy so that further approach processes will repeat shutdown of the drive at the position $T_C$.

It will be self-understood that even in the system of FIG. 3, with the first approach to the setpoint S the drive 11 can be deenergized when the control unit 17 reaches a position reduced from the setpoint position S by a correction value.

The systems of FIGS. 2 and 3 can be combined in that approaches A and B will both be corrected in the manner described in claim 2 by the iterative approach procedures there discussed. This ensures that even in the case of approaches A and B the final position of the machine element for each setpoint will be within the tolerance limits.

We claim:

1. A method of controlling a drive for a machine element, comprising the steps of:

(a) operating said drive to displace said machine element from a first position to at least one other position and which can be one of a plurality of target positions assumed by said machine element in successive operations;

(b) and generating actual position signals representing an instantaneous actual position of said machine element by a signal generator operatively coupled to said machine element;

(c) automatically comparing said instantaneous actual position as represented by said signals with a respective target position and deactivating said drive in dependence upon the comparison of said instantaneous actual position and a target position to bring said machine element to standstill;

(d) upon deactivation of said drive and standstill of said machine element comparing an actual position with the respective target position to determine a deviation therefrom; and (e) upon a subsequent approach to the same target position, deactivating said drive upon comparison of an actual position with the respective target position modified by at least one of said deviation and of a plurality of deviations previously ascertained by comparisons of actual positions with said target position.

2. A method of controlling a drive for a machine element, comprising the steps of:

(a) operating said drive to displace said machine element from a first position to at least one other position determined by a setpoint and which can be one of a plurality of positions determined by respective setpoints and assumed by said machine element in successive operations;

(b) detecting an instantaneous actual position of said machine element and generating actual position signals representing said instantaneous actual position of said machine element by a signal generator operatively coupled to said machine element;

(c) automatically comparing said instantaneous actual position as represented by said signals with a respective position forming a target position and deactivating said drive in dependence upon the comparison of said instantaneous actual position and a setpoint position corresponding to the respective setpoint to bring said machine element to standstill;

(d) upon deactivation of said drive and standstill of said machine element comparing an actual position ($Q_A$, $Q_B$, $Q_C$) with the respective setpoint position (S) to determine a deviation therefrom; and (e) upon a subsequent approach to the same setpoint position, deactivating said drive upon comparison of an actual position ($Q_A$, $Q_B$, $Q_C$) with the respective setpoint position (S) modified by at least one of said deviation and of a plurality of deviations previously ascertained by comparisons of actual positions with said setpoint position.

3. A method of controlling a drive for a machine element, comprising the steps of:

(a) operating said drive to displace said machine element from a first position to at least one other position constituting a target position and which can be assumed by said machine element in successive operations;

(b) detecting an instantaneous actual position of said machine element;

(c) automatically comparing said instantaneous actual position with a respective target position and deactivating said drive in dependence upon the comparison of said instantaneous actual position and a target position to bring said machine element to standstill;

(d) upon deactivation of said drive and standstill of said machine element comparing an actual position ($P_I$, $P_{II}$, $P_{III}$) with the respective target position (S) to determine a deviation therefrom;

(e) upon said deviation exceeding a predetermined value (δ) activating said drive to displace said machine element in a direction of said target position and again deactivating said drive upon coincidence of said instantaneous actual position and the target position to bring said machine element to standstill; and (f) repeating steps (d) and (e) until at least one of the following conditions is reached:

the determined deviation is less than at least one of the predetermined value (δ), and a predetermined number of repetitions of cycles of steps (c) and (d) are accomplished; and (g) upon a subsequent approach to the same setpoint position, deactivating said drive upon comparison of an actual position ($Q_A$, $Q_B$, $Q_C$) with the respective target position (S) modified by said deviation or by a plurality of deviations previously ascertained by comparisons of actual positions with said target position.

4. The method defined in claim 1, claim 2 or claim 3 wherein said drive is deactivated in step (c) when the instantaneous actual position coincides with said target position.

5. The method defined in claim 1, claim 2 or claim 3 wherein the target positions are established by a teach-in process by manually displacing said machine element at a speed less than a speed subsequently used for machine operation and manually registering the respective setpoints.

* * * * *